US010259217B2

(12) United States Patent
Hasegawa

(10) Patent No.: US 10,259,217 B2
(45) Date of Patent: Apr. 16, 2019

(54) INKJET PRINTER

(71) Applicant: Roland DG Corporation, Hamamatsu, Shizuoka (JP)

(72) Inventor: Hideyuki Hasegawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/908,932

(22) Filed: Mar. 1, 2018

(65) Prior Publication Data

US 2018/0264811 A1 Sep. 20, 2018

(30) Foreign Application Priority Data

Mar. 17, 2017 (JP) ..... 2017-053011

(51) Int. Cl.
*B41J 2/14* (2006.01)
*B41J 2/165* (2006.01)

(52) U.S. Cl.
CPC ..... *B41J 2/14* (2013.01); *B41J 2/16505* (2013.01); *B41J 2/16508* (2013.01); *B41J 2/16511* (2013.01); *B41J 2/16532* (2013.01); *B41J 2002/16514* (2013.01)

(58) Field of Classification Search
CPC ..... B41J 2/14; B41J 2/16505; B41J 2/16508; B41J 2/16511; B41J 2/16532
See application file for complete search history.

(56) References Cited

U.S. PATENT DOCUMENTS

2007/0263029 A1* 11/2007 Watanabe ..... B41J 2/16532 347/33
2009/0073221 A1* 3/2009 Yoda ..... B41J 2/16511 347/33

FOREIGN PATENT DOCUMENTS

JP 09-226151 A 9/1997
JP 2002-361897 A 12/2002
JP 3480687 B2 12/2003

* cited by examiner

*Primary Examiner* — Lamson D Nguyen
(74) *Attorney, Agent, or Firm* — Keating & Bennett, LLP

(57) ABSTRACT

In a printer, when a pressed member that is movable together with a movable table pressed by an ink head causes a movement mechanism to move the movable table and the pressed member slides on the ink head, caps are moved from a separate position to a cap position by changing relative positions of nozzle surfaces and the caps in a vertical direction without changing the relative positions of the nozzle surfaces and the caps in a main scanning direction.

25 Claims, 9 Drawing Sheets

INKJET PRINTER

CROSS REFERENCE TO RELATED APPLICATIONS

This application claims the benefit of priority to Japanese Patent Application No. 2017-053011 filed on Mar. 17, 2017. The entire contents of this application are hereby incorporated herein by reference.

BACKGROUND OF THE INVENTION

1. Field of the Invention

The present invention relates to an inkjet printer.

2. Description of the Related Art

Conventionally, an inkjet printer is known that includes an ink head having a plurality of nozzles and performs predetermined printing on a recording medium by inkjet printing process. Such an inkjet printer is provided with a capping unit to ensure appropriate ejection of ink from the nozzles. The capping unit has caps, each of which, during printing not in progress, covers a corresponding nozzle surface in which the nozzle is formed.

The capping unit covers the nozzle surface with the cap to form a closed space therebetween. When a suction pump connected to the capping unit is driven with the closed space being formed, ink having an increased viscosity is forcibly sucked from the nozzles. In other words, ink is forcibly discharged from the nozzles (which may be hereinafter referred to as "suction operation"). This prevents the nozzles from being clogged.

For example, Japanese Patent No. 3480687 discloses an inkjet printer having a configuration in which a cap approaches an ink head on a carriage to cover the ink head when an engagement member installed on the carriage comes into contact with an engagement portion attached to a slider.

In the inkjet printer of Japanese Patent No. 3480687, the cap makes a rotational movement along an arcuate path about an end of an arm. Thus, the cap slides on the nozzle surface of the ink head immediately before the cap covers the ink head. This causes wear of the cap and the nozzle surface, resulting in a decrease in the closeness of contact (air tightness) between the cap and the nozzle surface. This may eventually result in inappropriate suction operation. When the suction operation cannot be performed appropriately, clogging of the nozzles cannot be eliminated and the printing quality may be deteriorated.

SUMMARY OF THE INVENTION

Preferred embodiments of the present invention provide inkjet printers in each of which a cap is attachable to an ink head without decreasing closeness of contact between the cap and a nozzle surface of the ink head and is detachable from the ink head.

An inkjet printer according to the present invention includes a case; an ink head the case and including a nozzle opening; a head plate holding the ink head; a cap attachable to the ink head to cover the nozzle opening; a movable table provided with the cap and movable toward the ink head; and a pressed member located to be contacted and pushed by a contact portion of at least one of the case, the ink head and the head plate; wherein when the contact portion pushes the pressed member, the movable table moves upward toward the ink head while the contact portion and the pressed member slide relative to each other, and the cap covers the nozzle opening.

According to an inkjet printer of a preferred embodiment of the present invention, when the cap is moved from the separate position to the cap position, the ink head first comes into contact with the pressed member. When the ink head further presses the pressed member, the pressed member slides on the ink head. At this time, the relative positions of the nozzle surface and the cap in the main scanning direction do not change and the relative positions of the nozzle surface and the cap in the vertical direction change. As a result, the cap approaches the nozzle surface. Then, the cap is moved to the cap position, where it covers the nozzle surface, without sliding on the nozzle surface. Thus, when the cap is moved from the separate position to the cap position, wear can occur only between the ink head and the pressed member and no wear occurs between the nozzle surface and the cap. Thus, even when the cap is repeatedly attached to and detached from the ink head, a decrease in closeness of the contact between the cap and the nozzle surface is significantly reduced or prevented.

According to preferred embodiments of the present invention, inkjet printers in each of which a cap is attachable to an ink head without decreasing the closeness of contact between the cap and a nozzle surface and detachable from the ink head.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
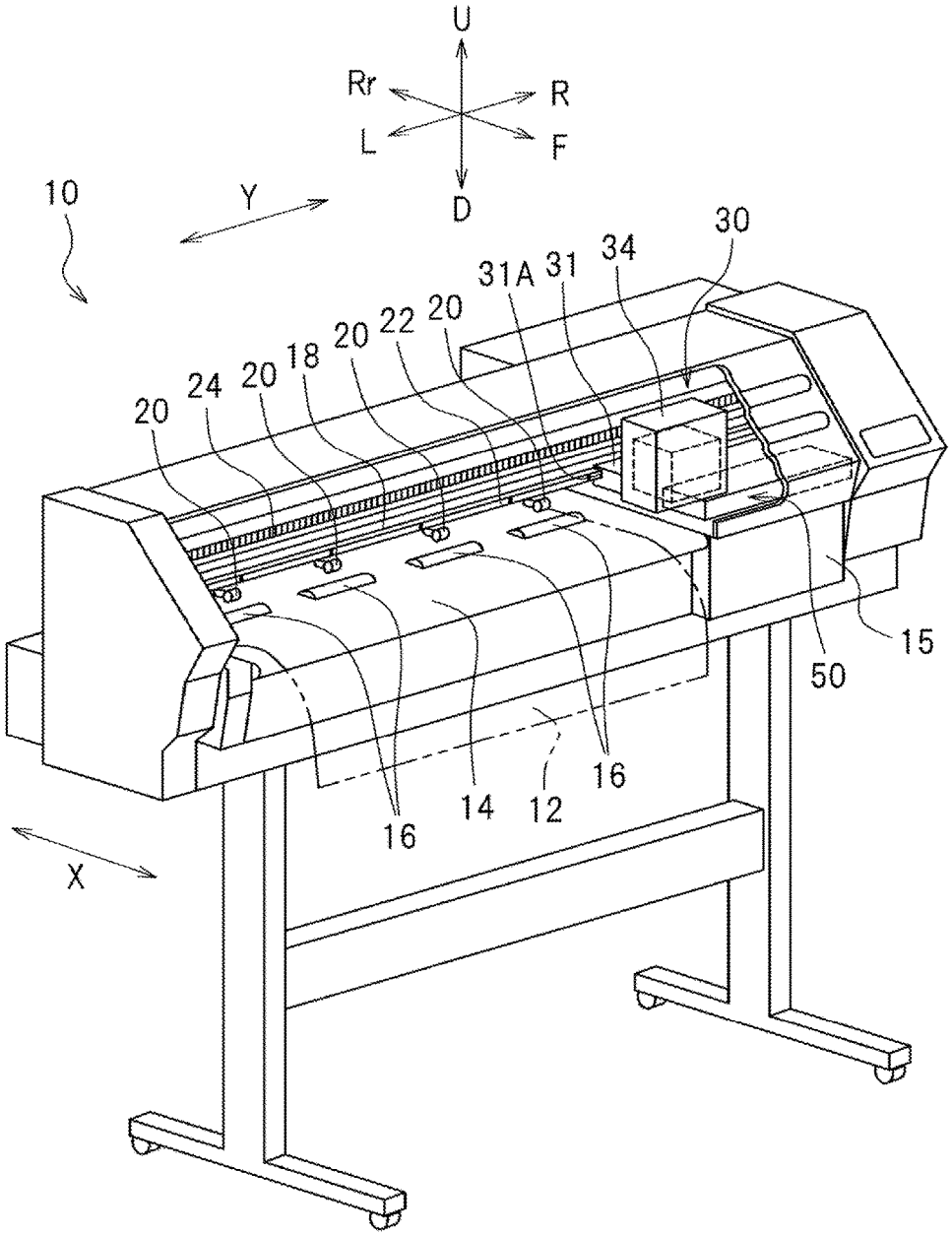
FIG. 1 is a partially cut-away perspective view, illustrating an inkjet printer according to a preferred embodiment of the present invention.

Description is hereinafter made of inkjet printers according to preferred embodiments of the present invention with reference to the drawings. It should be understood that the preferred embodiments described herein are not particularly intended to limit the present invention. In addition, members and elements that have the same functions are denoted by the same reference numerals or symbols and redundant description is omitted or simplified as appropriate.

FIG. 1 is a partially cut-away perspective view, illustrating an inkjet printer 10 (which is hereinafter referred to as "printer 10") according to the present preferred embodiment. As shown in FIG. 1, the printer 10 performs printing on a recording medium 12. The recording medium 12 is a recording paper, for example. The recording medium 12 is not limited to a recording paper. The recording medium 12 may be a sheet or film made from a resin such as polyvinyl chloride or polyester, a fabric such as woven fabric or nonwoven fabric, or another medium instead of a paper such as plain paper or inkjet printing paper.

In the following description, right, left, up and down refer to right, left, up and down as seen by an operator who is in front of the printer 10. The direction toward the operator and the direction away from the operator with respect to the printer 10 are defined as forward and rearward, respectively. The reference symbols F, Rr, L, R, U and D in the drawings represent front, rear, left, right, up and down, respectively. The reference symbol Y in the drawings represents a main scanning direction. In this preferred embodiment, the main scanning direction Y is a right-left direction. The main scanning direction Y is coincident with a width direction of the recording medium 12. The reference symbol X in the drawings represents a sub-scanning direction. The sub-scanning direction X is a direction across the main scanning direction Y (a direction across the main scanning direction Y at a right angle as seen in a plan view, for example). In this preferred embodiment, the sub-scanning direction X is a front-rear direction. The sub-scanning direction X is coincident with a longitudinal direction of the recording medium 12. These are, however, directions determined for convenience sake, and should not be interpreted restrictively.

As shown in FIG. 1, the printer 10 includes a platen 14 on which the recording medium 12 is placed. The platen 14 is provided with cylindrical grid rollers 16 as movement mechanisms. The grid rollers 16 are embedded for rotation in the platen 14 with their upper surface exposed. The grid rollers 16 are driven by a feed motor (not shown).

As shown in FIG. 1, a guide rail 18 is installed above the platen 14. The guide rail 18 is installed parallel or substantially parallel to the platen 14, and extends in the main scanning direction Y. A plurality of pinch rollers 20 are arranged at generally regular intervals below the guide rail 18. The pinch rollers 20 are opposed to the grid rollers 16. The position of the pinch rollers 20 in a vertical direction can be set depending on the thickness of the recording medium 12. The recording medium 12 is pinched between the pinch rollers 20 and the grid rollers 16. The grid rollers 16 and the pinch rollers 20 transport the recording medium 12 in the sub-scanning direction X while pinching the recording medium 12 therebetween. The guide rail 18 includes an engagement portion 22 protruding forward.

Figure 2:
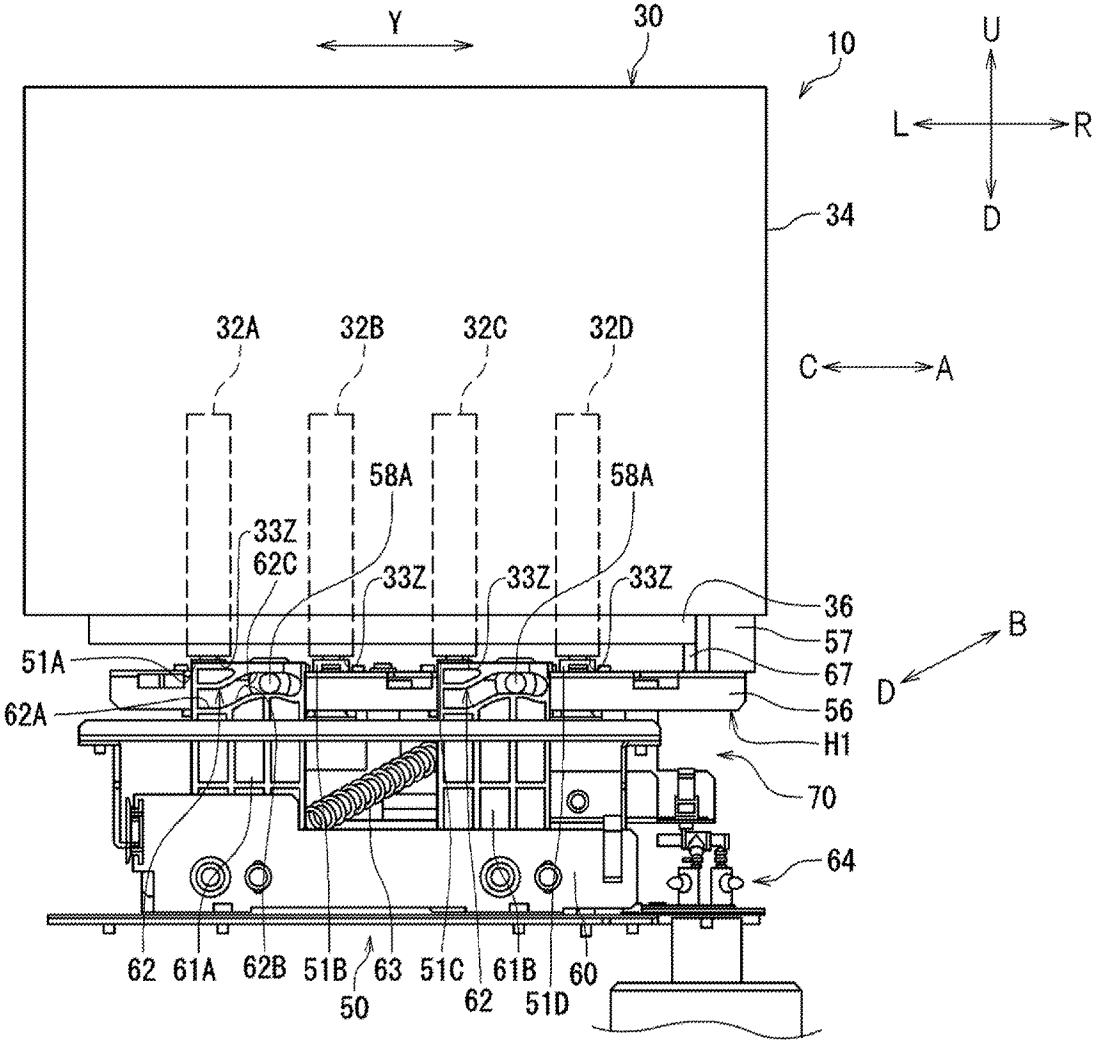
FIG. 2 is a front view, illustrating a portion of the inkjet printer according to the preferred embodiment of the present invention.

As shown in FIG. 1, the printer 10 includes an ink head unit 30. The ink head unit 30 is installed above the platen 14. As shown in FIG. 2, the ink head unit 30 includes a plurality of ink heads 32A, 32B, 32C and 32D, a case 34, a head plate 36, and a carriage 31 (refer to FIG. 1). The case 34 is disposed on the carriage 31. The plurality of ink heads 32A to 32D are housed in the case 34 in such a manner that nozzle surfaces 33Z (refer to FIG. 3) of the ink heads 32A to 32D, which are described later, are exposed to the outside. The plurality of ink heads 32A to 32D are mounted on the carriage 31. The head plate 36 is provided on the carriage 31. The case 34 is attached to an upper portion of the head plate 36.

As shown in FIG. 1, the carriage 31 includes a recess 31A recessed forward at rear portion thereof. The engagement portion 22 of the guide rail 18 is in engagement with the recess 31A. The carriage 31 is movable in the main scanning direction Y along the guide rail 18.

As shown in FIG. 1, part of a driving belt 24 extending in the main scanning direction Y is fixed to upper rear part of the case 34. The driving belt 24 is an annular endless belt. The driving belt 24 is connected to a scan motor (not shown), and is driven to rotate by the scan motor. When the driving belt 24 runs, the carriage 31 moves in the main scanning direction Y along the guide rail 18. The ink head unit 30 (refer to FIG. 2) is movable via the carriage 31 in the main scanning direction Y along the guide rail 18.

Figure 3:
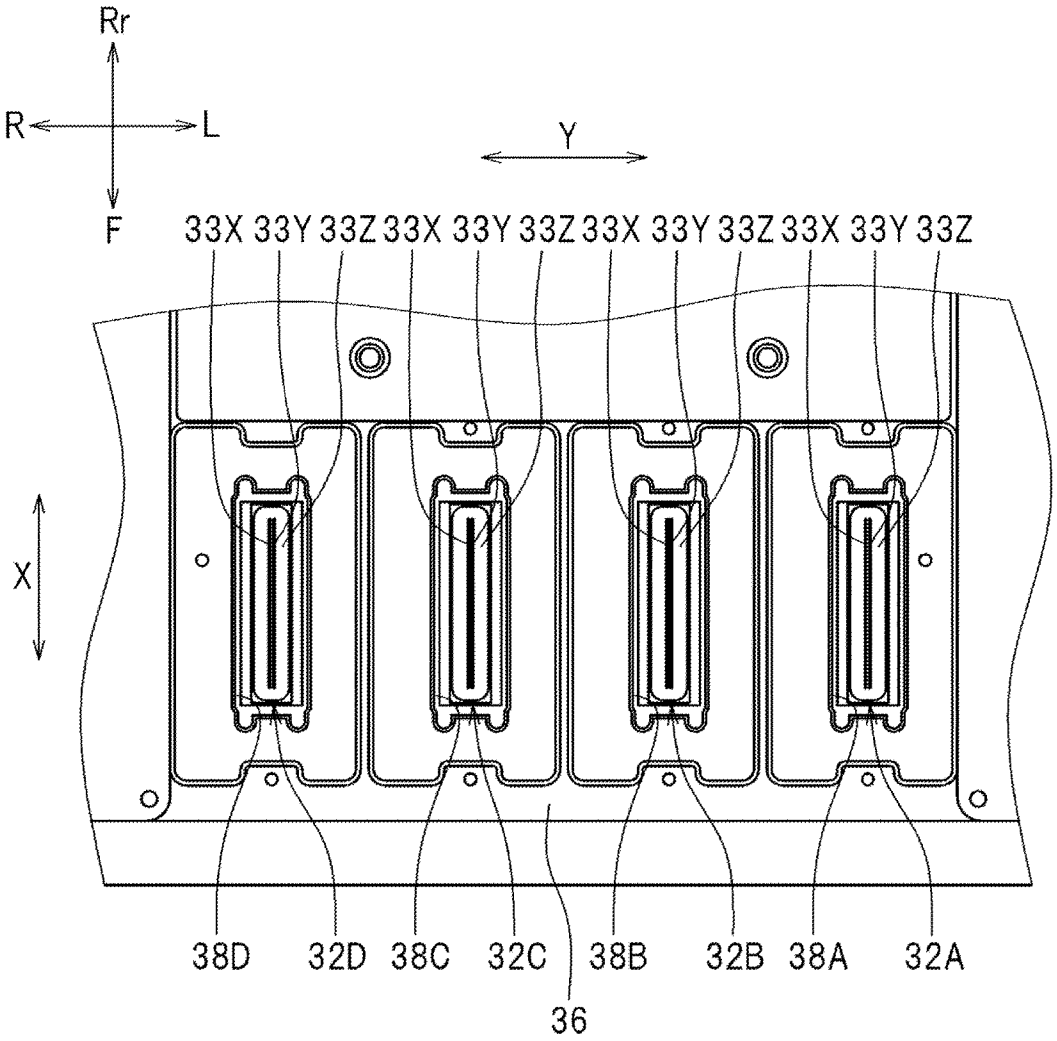
FIG. 3 is a bottom view, illustrating ink heads according to a preferred embodiment of the present invention.

As shown in FIG. 3, the ink heads 32A to 32D have a shape that is longer in the front-rear direction than in the right-left direction. The ink heads 32A to 32D have the same shape and size. Each of the ink heads 32A to 32D includes a plurality of first nozzles 33X aligned in the sub-scanning direction X, a plurality of second nozzles 33Y aligned in the sub-scanning direction X, and a nozzle surface 33Z in which the first nozzles 33X and the second nozzles 33Y are formed. The first nozzles 33X and the second nozzles 33Y eject an ink onto the recording medium 12. The inside of the first nozzles 33X and the inside of the second nozzles 33Y are set at a negative pressure (a pressure lower than the atmospheric pressure). Because the first nozzles 33X and second nozzles 33Y are fine, the plurality of first nozzles 33X and the plurality of second nozzles 33Y are shown as straight lines in FIG. 3. The ink heads 32A to 32D, which include two types of nozzles, the first nozzles 33X and the second nozzles 33Y, in this preferred embodiment, may include one type of nozzles or three or more types of nozzles.

As shown in FIG. 3, the head plate 36 includes a plurality of openings 38A, 38B, 38C and 38D aligned in the main scanning direction Y. The openings 38A to 38D have a shape that is longer in the front-rear direction than in the right-left direction. The openings 38A to 38D have the same shape and size. The openings 38A to 38D are located in the same position with respect to the sub-scanning direction X. The ink heads 32A to 32D are attached in the openings 38A to 38D, respectively. The first nozzles 33X and the second nozzles 33Y are located in the openings 38A to 38D as seen from bottom. The first nozzles 33X and the second nozzles 33Y are exposed to the outside through the openings 38A to 38D. As shown in FIG. 2, the nozzle surfaces 33Z are located at positions lower than the head plate 36.

As shown in FIG. 1, the printer 10 includes a capping unit 50. The capping unit 50 is installed on a lateral member 15 located to the right of the platen 14. The capping unit 50 is installed at a position lower than the ink head unit 30. The capping unit 50 performs a suction operation. As shown in FIG. 2, the capping unit 50 includes a plurality of caps 51A, 51B, 51C and 51D, a movable table 56, a pressed member 57, a movement mechanism 70, and a suction pump 64. The movable table 56 is one example of a movable member. The suction pump 64 is an example of a suction unit. The suction pump 64 sucks fluids (for example, air and ink) in closed spaces 50S, which are described later. The suction pump 64 sucks the ink in the first nozzles 33X (refer to FIG. 3) and the ink in the second nozzles 33Y (refer to FIG. 3). The suction pump 64 sucks the ink in the caps 51A to 51D.

Figure 4:
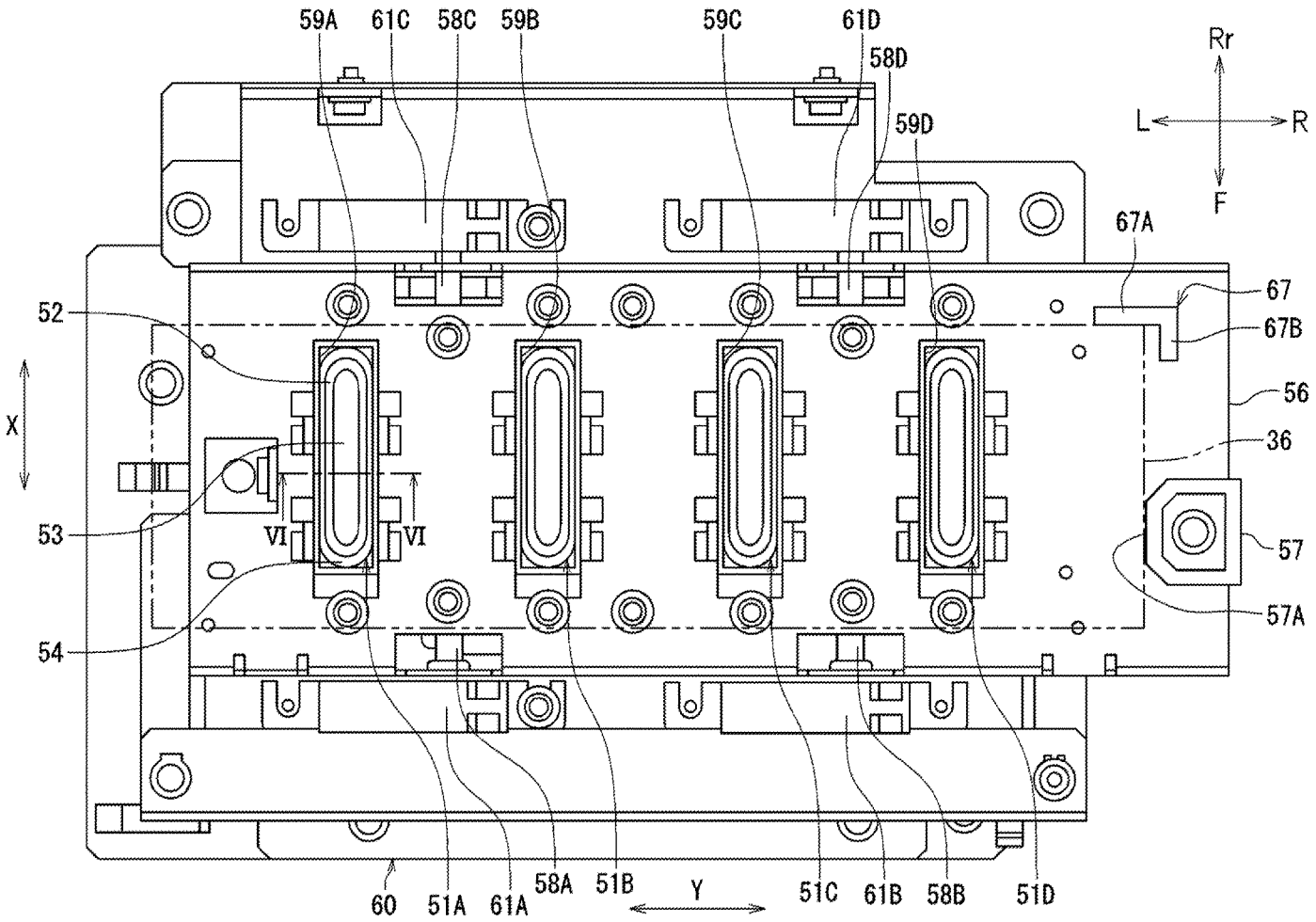
FIG. 4 is a plan view, illustrating a capping unit according to a preferred embodiment of the present invention.

As shown in FIG. 4, the caps 51A to 51D are disposed on the movable table 56. The caps 51A to 51D are mounted in openings 59A to 59D, respectively, located in the movable table 56. The caps 51A to 51D are aligned in the main scanning direction Y. The caps 51A to 51D have a shape that is longer in the front-rear direction than in the right-left direction. The caps 51A to 51D have the same shape and size. The caps 51A to 51D are attachable to and detachable from the ink heads 32A to 32D to cover the nozzle surfaces 33Z (refer to FIG. 3) of the ink heads 32A to 32D. The expression "cover the nozzle surfaces 33Z" includes not only the case where the nozzle surfaces 33Z are entirely covered but also the case where at least the first nozzles 33X and the second nozzles 33Y are entirely covered. Because the cap 51A has the same configuration as the caps 51B to 51D, only the cap 51A is described in the following.

Figure 5:
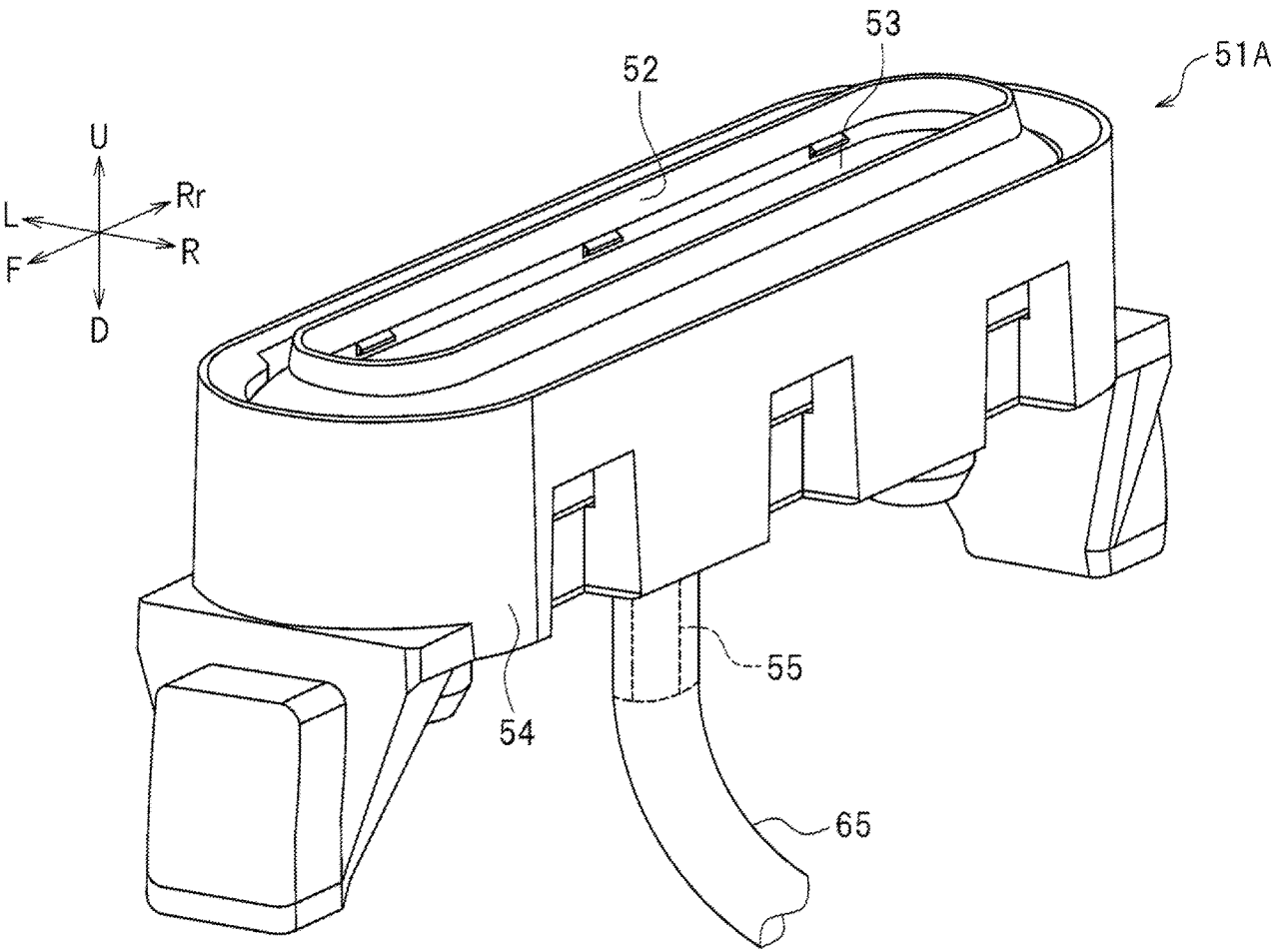
FIG. 5 is a perspective view, illustrating a cap according to a preferred embodiment of the present invention.
Figure 6:
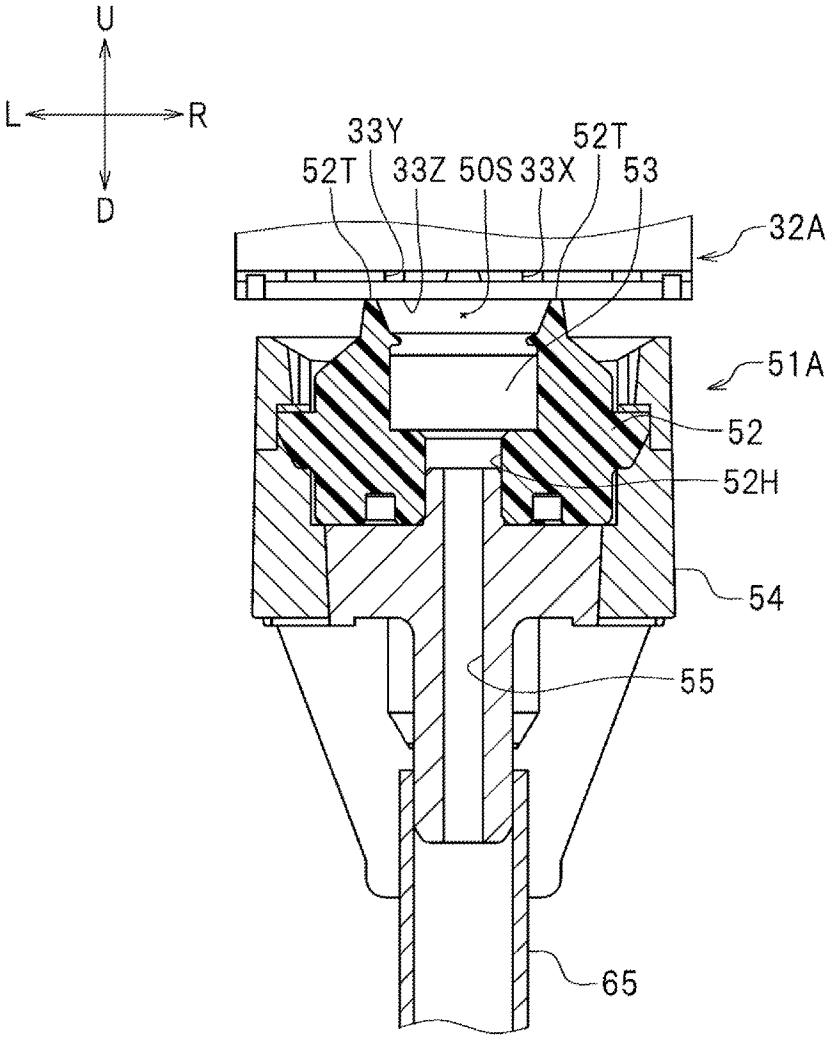
FIG. 6 is a cross-sectional view, taken along the line VI-VI in FIG. 4.

As shown in FIG. 5, the cap 51A includes a lip portion 52, an absorbent 53, a main case 54, and an ink flow path 55 (refer also to FIG. 6). The cap 51A is attachable to and detachable from the ink head 32A to cover the nozzle surface 33Z (refer to FIG. 3). As shown in FIG. 6, when the cap 51A is attached to the ink head 32A, a closed space 50S is provided between the cap 51A and the nozzle surface 33Z.

As shown in FIG. 6, the lip portion 52 opens upward. The lip portion 52 is installed in the main case 54. The lip portion 52 is provided in the main case 54 and is contactable with the nozzle surface 33Z (refer to FIG. 3). When the lip portion 52 is in contact with the nozzle surface 33Z, the closed space 50S is formed between the lip portion 52 and the nozzle surface 33Z. A pressure lower than atmospheric pressure is created in the closed space 50S. The lip portion 52 is flexible. For example, the lip portion 52 may be made from a rubber. As shown in FIG. 4, the lip portion 52 has an ellipsoidal shape as seen in a plan view. As shown in FIG. 6, a through hole 52H is located in a lower portion of the lip portion 52. The through hole 52H is communicated with the ink flow path 55.

As shown in FIG. 6, the absorbent 53 is installed in the lip portion 52. The absorbent 53 is installed at a position higher than the through hole 52H and lower than an upper end 52T of the lip portion 52. The absorbent 53 is made of a porous material for absorption of ink. Examples of the absorbent 53 include a sponge.

As shown in FIG. 6, the ink flow path 55 extends through the main case 54. The ink flow path 55 is located under the through hole 52H. The ink flow path 55 extends vertically. A suction tube 65 is connected to the main case 54 of the cap 51A. The suction tube 65 is communicated with the ink flow path 55. The suction tube 65 is also connected to the suction pump 64 (refer to FIG. 2).

As shown in FIG. 2, the suction pump 64 is installed in the lateral member 15 (refer to FIG. 1). The suction pump 64 is installed to the right of the capping unit 50. The suction pump 64 is coupled to the caps 51A to 51D via the suction tubes 65 (refer to FIG. 6). When the air in the closed spaces 50S (refer to FIG. 6) is sucked by the suction pump 64, the ink in the first nozzles 33X and the second nozzles 33Y of the ink heads 32A to 32D can be discharged to the outside of the first nozzles 33X and the second nozzles 33Y to prevent clogging thereof. The ink discharged to the outside of the first nozzles 33X and the second nozzles 33Y is sucked by the suction pump 64 and retained in a waste tank (not shown).

As shown in FIG. 2, the movement mechanism 70 includes the movable table 56. The movement mechanism 70 moves the movable table 56 in the main scanning direction Y and in a vertical direction in synchronization with the movement of the ink heads 32A to 32D (in other words, the ink head unit 30). The caps 51A to 51D on the movable table 56 are therefore moved in the main scanning direction Y and in a vertical direction between a cap position H1 where the caps 51A to 51D cover their corresponding nozzle surfaces 33Z (refer to FIG. 2) and a separate position H2 where the caps 51A to 51D are separated from the nozzle surfaces 33Z (refer to FIG. 7). The movement mechanism 70 includes a support table 60 and a spring 63.

The support table 60 is installed below the movable table 56 and supports the movable table 56. As shown in FIG. 4, the support table 60 includes a plurality of support plates 61A, 61B, 61C and 61D. The support plates 61A to 61D are elongated vertically. The support plates 61A and 61B are installed in front of the movable table 56, while the support plates 61C and 61D are installed behind the movable table 56. As shown in FIG. 2, each of the support plates 61A and 61B includes a guide groove 62. The guide groove 62 includes a first portion 62A extending in a right-left direction, a second portion 62B extending obliquely upward from a right end of the first portion 62A, and a third portion 62C extending rightward from a right end of the second portion 62B. The third portion 62C is located higher than the first portion 62A. As in the case of the support plates 61A and the support plate 61B, each of the support plates 61C and 61D also includes a guide groove 62.

As shown in FIG. 2, the spring 63 has one end connected to the support table 60 and the other end connected to the movable table 56. Examples of the spring 63 include a helical tension spring. The spring 63 biases the movable table 56 downward.

As shown in FIG. 4, the movable table 56 preferably has a rectangular shape as seen in a plan view, for example. The movable table 56 includes a plurality of shafts 58A, 58B, 58C and 58D. The shafts 58A to 58D protrude outward from the movable table 56. The shafts 58A and 58B protrude forward. The shafts 58C and 58D protrude rearward. The shafts 58A to 58D are received in the guide grooves 62 of the support plates 61A to 61D, respectively. The shafts 58A to 58D are movable in the guide grooves 62.

As shown in FIG. 4, the pressed member 57 is movable together with the movable table 56. The pressed member 57 preferably has the shape of a square pillar, for example. In this preferred embodiment, the pressed member 57 is provided on the movable table 56. The pressed member 57 is installed to the right of the cap 51D. The pressed member 57 is provided at a right end of the movable table 56. The pressed member 57 is able to be pressed by the ink head unit 30. In this preferred embodiment, the pressed member 57 is installed in such a position that it is able to be pressed by the head plate 36. The pressed member 57 is made from a resin material, and preferably has a wear rate, as defined in JIS K7205, that is greater than that of the head plate 36. The ratio of the wear rate B of the head plate 36 to the wear rate A of the pressed member 57 (wear rate B/wear rate A) preferably is about 0.005 to about 0.750, for example.

As shown in FIG. 4, the movable table 56 is provided with a contact member 67. The contact member 67 is movable together with the movable table 56. The contact member 67 has an L-shaped configuration. The contact member 67 includes a first portion 67A extending in the main scanning direction Y, and a second portion 67B extending in the sub-scanning direction X. The first portion 67A is contactable with the ink head unit 30. In this preferred embodiment, the first portion 67A is installed in such a position that it is contactable with the head plate 36. The second portion 67B is located farther to the right than a pressing face 57A of the pressed member 57. The second portion 67B usually does not contact the ink head unit 30.

Figure 7:
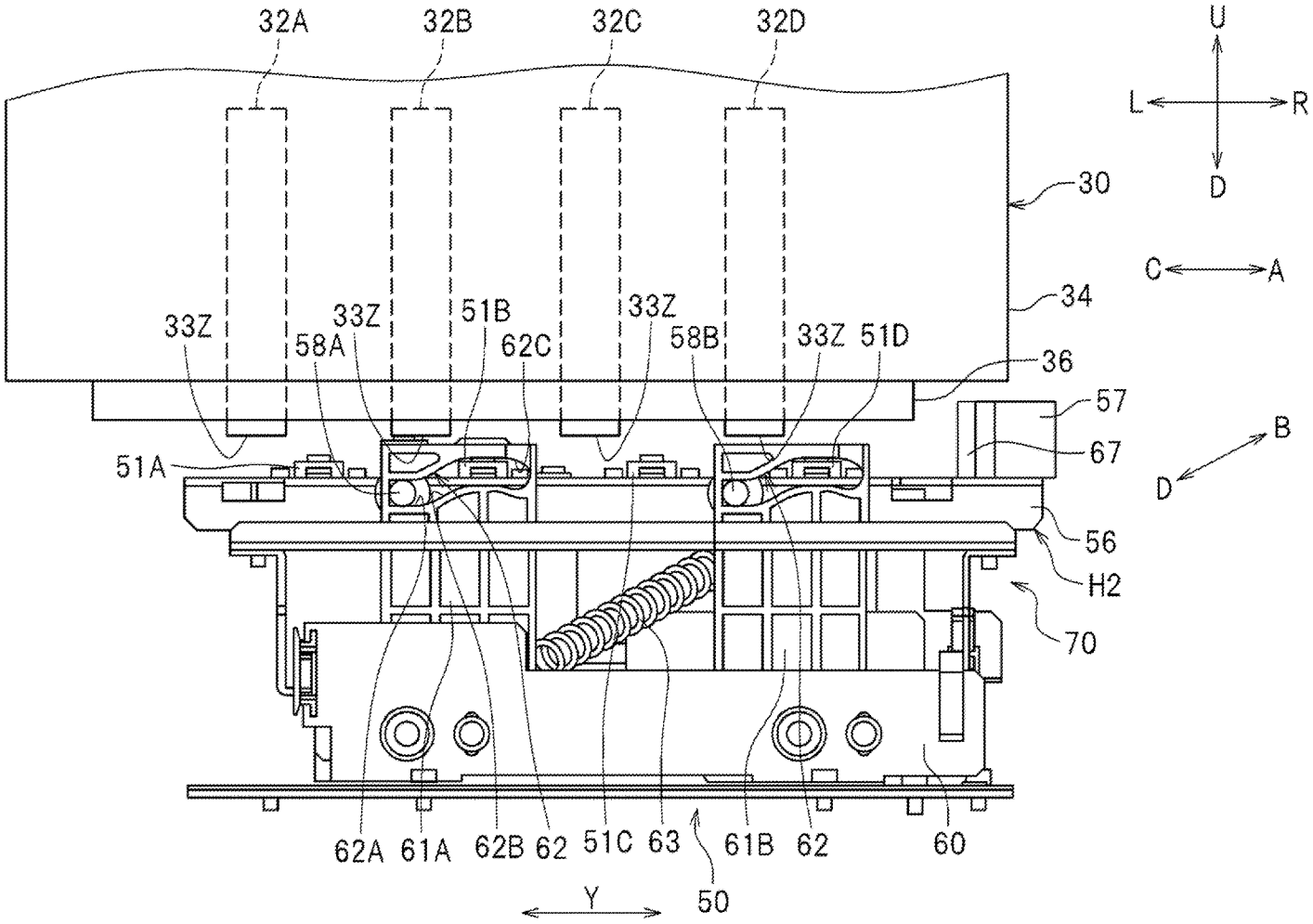
FIG. 7 is a front view, illustrating a state where an ink head unit according to a preferred embodiment of the present invention is moving toward a pressed member.
Figure 8:
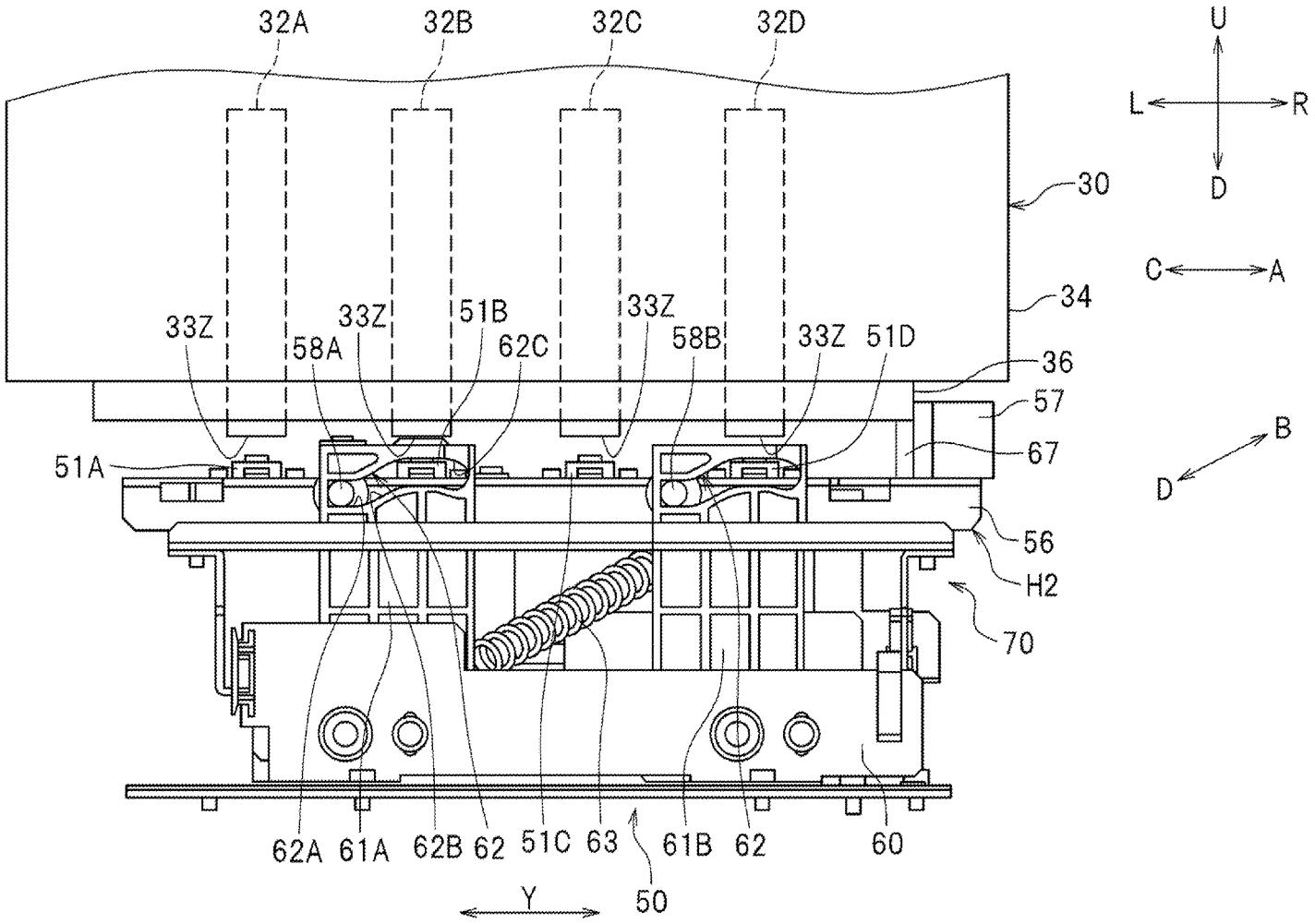
FIG. 8 is a front view, illustrating a state where the ink head unit according to a preferred embodiment of the present invention is in contact with the pressed member.
Figure 9:
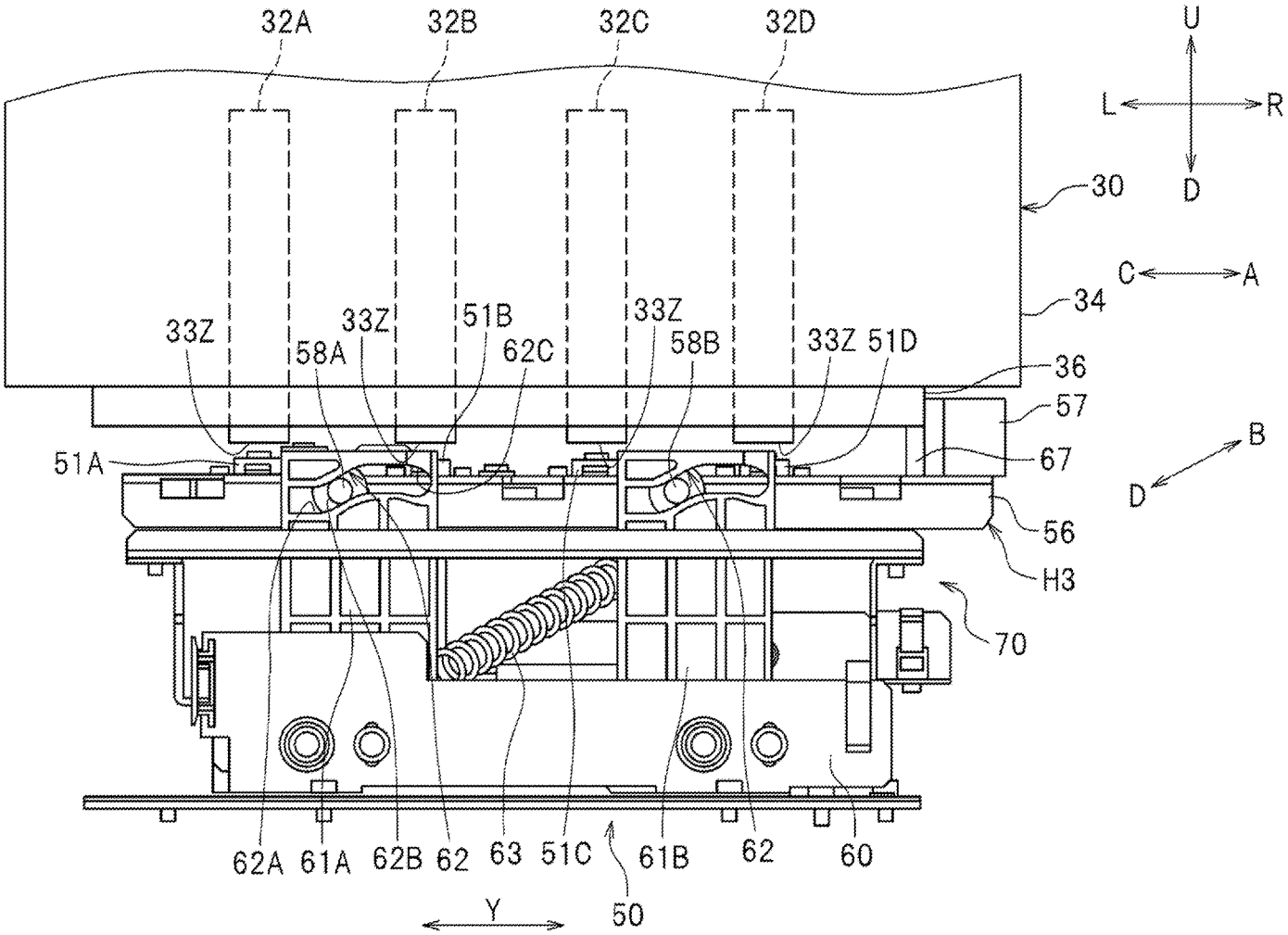
FIG. 9 is a front view, illustrating a state where the ink head unit and the pressed member according to a preferred embodiment of the present invention are sliding on each other.

The movable table 56 is movable in the main scanning direction Y and in a vertical direction between the cap position H1 (refer to FIG. 2) and the separate position H2 (refer to FIG. 7). The cap position H1 corresponds to a position where the movable table 56 is in its highest position (in other words, the caps 51A to 51D are in their highest positions) (refer to FIG. 2). The separate position H2 corresponds to a position where the movable table 56 is in its lowest position (in other words, the caps 51A to 51D are in their lowest positions) (refer to FIGS. 7 and 8). Here, a position H3 (refer to FIG. 9) where the movable table 56 is in a position between the position H1 and the position H2 (in other words, a position where the closed spaces 50S are not formed) also corresponds to a separate position.

As shown in FIG. 7, when the head plate 36 is not pressing the pressed member 57, the movable table 56 is remained at the position H2 because it is biased downward by the spring 63. When the head plate 36 is moved rightward (in the direction of an arrow A in FIG. 7) in synchronization with the movement of the carriage 31, the head plate 36 comes into contact with the pressed member 57 (refer to FIG. 8). At this time, the head plate 36 comes into contact with an approximately upper 20% region of the pressed member 57. When the head plate 36 comes into contact with the pressed member 57, the cap 51A is located below the nozzle surface 33Z of the ink head 32A, the cap 51B is located below the nozzle surface 33Z of the ink head 32B, the cap 51C is located below the nozzle surface 33Z of the ink head 32C, and the cap 51D is located below the nozzle surface 33Z of the ink head 32D. At this time, the nozzle surfaces 33Z of the ink heads 32A to 32D are not in contact with the caps 51A to 51D.

When the head plate 36 is moved farther rightward, the pressed member 57 is pressed by the head plate 36 and moved rightward. Then, the movement mechanism 70 moves the movable table 56 against the biasing force of the spring 63. More specifically, the shafts 58A to 58D of the movable table 56 move in the guide grooves 62 from the first portions 62A into the second portions 62B. Then, the movable table 56 moves in the direction of an arrow B in FIG. 8 (here, an obliquely upward and rightward). As a result, the movable table 56 moves to the position H3, which is located higher than the position H2 (refer to FIG. 9). When the movable table 56 moves from the position H2 to the position H3, the pressed member 57 slides on the head plate 36. In other words, the contact area between the head plate 36 and the pressed member 57 gradually increases. Because the pressed member 57 moves upward with the pressed member 57 and the head plate 36 in contact with each other in this way, wear can occur between the pressed member 57 and the head plate 36. At this time, the relative positions of the nozzle surfaces 33Z of the ink heads 32A to 32D and the caps 51A to 51D in the main scanning direction Y do not change. On the other hand, the relative positions of the nozzle surfaces 33Z of the ink heads 32A to 32D and the caps 51A to 51D in a vertical direction change. In other words, the caps 51A to 51D approach the nozzle surfaces 33Z and the distance between the nozzle surfaces 33Z of the ink heads 32A to 32D and the caps 51A to 51D decreases.

When the head plate 36 moves farther rightward, the pressed member 57 is pressed by the head plate 36 and the shafts 58A to 58D of the movable table 56 move in the guide grooves 62 from the second portions 62B into the third portions 62C. The movable table 56 therefore further moves in the direction of the arrow B in FIG. 9 to the position H1, which is located higher than the position H3. When the movable table 56 reaches the position H1, the caps 51A to 51D are attached to the ink heads 32A to 32D, respectively, and the closed spaces 50S (refer to FIG. 6) are provided between the caps 51A to 51D and the nozzle surfaces 33Z. When the closed spaces 50S are formed, the head plate 36 is in contact with approximately upper 50% region of the pressed member 57. At this time, because the relative positions of the nozzle surfaces 33Z of the ink heads 32A to 32D and the caps 51A to 51D in the main scanning direction Y do not change and the relative positions of the nozzle surfaces 33Z of the ink heads 32A to 32D and the caps 51A to 51D in a vertical direction change, the caps 51A to 51D do not slide on the nozzle surfaces. Thus, when the caps 51A to 51D move from the separate position (refer to the position H2) to the cap position (refer to position H1), wear can occur only between the pressed member 57 and the head plate 36.

When the head plate 36 moves leftward (in the direction of an arrow C in FIG. 2) from the state where the movable table 56 is in the position H1, the shafts 58A to 58D of the movable table 56 move in the guide grooves 62 from the third portions 62C into the first portions 62A. Then, the movable table 56 moves in the direction of an arrow D in FIG. 2 (here, obliquely downward and leftward) (moves from the position H1 to the position H2), and the caps 51A to 51D are removed from the ink heads 32A to 32D, respectively. Between a moment immediately before the head plate 36 starts pressing the pressed member 57 and a moment immediately after the head plate 36 stops pressing the pressed member 57, the nozzle surfaces 33Z of the ink heads 32A to 32D are located above the caps 51A to 51D. In other words, the relative positional relationship between the nozzle surfaces 33Z of the ink heads 32A to 32D and the caps 51A to 51D in the main scanning direction Y does not change.

As described above, in the printer 10 of this preferred embodiment, when the caps 51A to 51D are moved from the separate position H2 to the cap position H1, the ink head unit 30 first comes into contact with the pressed member 57. When the ink head unit 30 further presses the pressed member 57, the pressed member 57 slides on the ink head unit 30. At this time, the relative positions of the nozzle surfaces 33Z of the ink heads 32A to 32D and the caps 51A to 51D in the main scanning direction Y do not change, whereas the relative positions of the nozzle surfaces 33Z of the ink heads 32A to 32D and the caps 51A to 51D in a vertical direction change and the caps 51A to 51D approach the nozzle surfaces 33Z. Then, the caps 51A to 51D move to the cap position H1, where the caps 51A to 51D cover the nozzle surfaces 33Z, without sliding on the nozzle surfaces 33Z. Thus, when the caps 51A to 51D move from the separate position H2 to the cap position H1, wear caused by sliding motion can occur only between the ink head unit 30 and the pressed member 57 and no wear occurs between the nozzle surfaces 33Z and the caps 51A to 51D. Thus, even when the caps 51A to 51D are repeatedly attached to and detached from the ink heads 32A to 32D, a decrease in closeness of the contact between the caps 51A to 51D and the nozzle surfaces 33Z is significantly reduced or prevented.

According to the printer 10 of this preferred embodiment, the ink head unit 30 preferably includes the head plate 36 including the openings 38A to 38D, in which the ink heads 32A to 32D are attached, and the movement mechanism 70 moves the movable table 56 when the pressed member 57 is pressed by the head plate 36. Thus, when the caps 51A to 51D move from the separate position H2 to the cap position H1, wear caused by sliding motion can occur only between the head plate 36 and the pressed member 57 and wear between the nozzle surfaces 33Z and the caps 51A to 51D is significantly reduced or prevented.

According to the printer 10 of this preferred embodiment, the wear rate of the pressed member 57 is preferably higher than that of the head plate 36. Because the pressed member 57 is able to be replaced more easily than the head plate 36 in general, maintenance is relatively easy when the pressed member 57, which is easier to replace, wears earlier.

According to the printer 10 of this preferred embodiment, the pressed member 57 is provided on the movable table 56. This configuration improves the degree of freedom of the layout of the pressed member 57.

Preferred embodiments of the present invention have been described in the foregoing. However, the above preferred embodiments are for illustrative purposes only, and the present invention is able to be implemented in various different ways.

In the above preferred embodiments, the head plate 36 preferably presses the pressed member 57 and the pressed member 57 slides on the head plate 36. However, this is not limitative. For example, the movement mechanism 70 may move the movable table 56 when the pressed member 57 is pressed by the case 34. In this case, when the caps 51A to 51D move from the separate position H2 to the cap position H1, wear can occur only between the case 34 and the pressed member 57 and wear between the nozzle surfaces 33Z and the caps 51A to 51D is significantly reduced or prevented. In this case, the pressed member 57 is made from a resin material and preferably has a wear rate, as defined in JIS K7205, that is greater than that of the case 34. Because the pressed member 57 is able to be replaced more easily than the case 34 in general, maintenance is relatively easy when the pressed member 57, which is easier to replace, wears earlier. The ratio of the wear rate C of the case 34 to the wear rate A of the pressed member 57 (wear rate C/wear rate A) preferably is about 0.005 to about 0.750, for example.

Alternatively, the movement mechanism 70 may move the movable table 56 when the pressed member 57 is pressed by a side surface (a surface different from the nozzle surface 33Z) of the ink head 32D. In this case, when the caps 51A to 51D move from the separate position H2 to the cap position H1, wear can occur only between the side surface of the ink head 32D and the pressed member 57 and wear between the nozzle surfaces 33Z and the caps 51A to 51D is therefore significantly reduced or prevented. In this case, the pressed member 57 is made from a resin material and preferably has a wear rate, as defined in JIS K7205, that is greater than that of the side surface of the ink head 32D. Because the pressed member 57 is able to be replaced more easily than the ink head 32D in general, maintenance is relatively easy when the pressed member 57, which is easier to replace, wears earlier. The ratio of the wear rate D of the side surface of the ink head 32D to the wear rate A of the pressed member 57 (wear rate D/wear rate A) preferably is about 0.005 to about 0.750, for example.

In the above preferred embodiments, the pressed member 57 preferably is provided on the movable table 56. However, this is not limitative. For example, the pressed member 57 may be provided on at least one of the caps 51A to 51D. For example, when the pressed member 57 is provided on the cap 51A, the pressed member 57 is pressed by a side surface of the ink head 32A.

In the above preferred embodiments, the movement mechanism 70 moves the movable table 56 in the main scanning direction Y and in a vertical direction. However, this is not limitative. For example, the movement mechanism 70 may move the movable table 56 in the sub-scanning direction X in addition to the main scanning direction Y and in a vertical direction. In this case, the movable table 56 moves obliquely with respect to the ink head unit 30 as seen in a plan view.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:
- a case;
- an ink head in the case and including a nozzle opening;
- a head plate holding the ink head;
- a cap attachable to the ink head to cover the nozzle opening;
- a movable table provided with the cap and movable toward the ink head; and
- a pressed member located to be contacted and pushed by a contact portion of at least one of the case, the ink head and the head plate; wherein
- when the contact portion pushes the pressed member, the movable table moves upward toward the ink head while the contact portion and the pressed member slide relative to each other, and the cap covers the nozzle opening.

2. The inkjet printer according to claim 1, wherein the contact portion is a portion of the ink head.

3. The inkjet printer according to claim 1, wherein the contact portion is a portion of the case.

4. The inkjet printer according to claim 1, wherein the contact portion is a portion of the head plate.

5. The inkjet printer according to claim 1, wherein the contact portion includes a portion of the head plate and a portion of the case.

6. The inkjet printer according to claim 1, wherein the pressed member is directly disposed on the movable table.

7. The inkjet printer according to claim 1, wherein the pressed member is directly disposed on the cap.

8. The inkjet printer according to claim 1, wherein the pressed member is made from a resin material and has a wear rate, as defined in JIS K7205, that is greater than that of the head plate.

9. The inkjet printer according to claim 1, wherein the head plate is integral with the case.

10. An inkjet printer, comprising:
- a head main body including at least:
  - a case;
  - an ink head in the case and including a nozzle opening; and
  - a head plate holding the ink head;
- a cap attachable to the ink head to cover the nozzle opening;
- a movable table provided with the cap and movable toward the head main body; and
- a pressed member located to be contacted and pushed by the head main body at a contact portion; wherein
  - when the head main body pushes the pressed member, the movable table moves upward toward the head main body while the head main body and the pressed member slide relative to each other, and the cap covers the nozzle opening;
  - the pressed member has a greater wear rate than the contact portion of the head main body.

11. The inkjet printer according to claim 10, wherein the contact portion is a portion of the ink head.

12. The inkjet printer according to claim 10, wherein the contact portion is a portion of the case.

13. The inkjet printer according to claim 10, wherein the contact portion is a portion of the head plate.

14. The inkjet printer according to claim 10, wherein the pressed member is directly disposed on the movable table.

15. The inkjet printer according to claim 10, wherein the pressed member is directly disposed on the cap.

16. The inkjet printer according to claim 10, wherein the pressed member is made from a resin material and has a wear rate, as defined in JIS K7205, that is greater than that of the head plate.

17. The inkjet printer according to claim 10, wherein the head plate is integral with the case.

18. An inkjet printer, comprising:

a head main body including at least:

a case;

an ink head in the case and including a nozzle opening; and a head plate holding the ink head;

a cap attachable to the ink head to cover the nozzle opening;

a movable table provide with the cap and movable toward the head main body; and a pressed member located to be contacted and pressed by the head main body at a contact portion; wherein when the head main body pushes the pressed member, the movable table moves upward toward the head main body while the head main body and the pressed member slide relative to each other, and the cap covers the nozzle opening;

the contact portion and the pressed member are made of different materials.

19. The inkjet printer according to claim 18, wherein the pressed member is made from a resin material and has a wear rate, as defined in JIS K7205, that is greater than that of the head plate.

20. The inkjet printer according to claim 18, wherein the pressed member is made from a resin material and the head main body is made of metal.

21. The inkjet printer according to claim 18, wherein the contact portion is a portion of the ink head.

22. The inkjet printer according to claim 18, wherein the contact portion is a portion of the case.

23. The inkjet printer according to claim 18, wherein the contact portion is a portion of the head plate.

24. The inkjet printer according to claim 18, wherein the pressed member is directly disposed on the movable table.

25. The inkjet printer according to claim 18, wherein the pressed member is directly disposed on the cap.

* * * * *